United States Patent [19]

McGuire

[11] Patent Number: 4,630,660

[45] Date of Patent: Dec. 23, 1986

[54] DOWELL MAKING

[76] Inventor: William J. McGuire, 13 Albert Rd., Moonah, Tasmania 7009, Australia

[21] Appl. No.: 748,468

[22] Filed: Jun. 25, 1985

[51] Int. Cl.[4] ..... B27B 1/00

[52] U.S. Cl. ..... 144/363; 144/4; 144/23; 144/253 R; 408/204

[58] Field of Search ..... 144/40, 12, 30, 39, 144/363, 23, 4, 365, 253 E, 253 R; 408/204

[56] References Cited

U.S. PATENT DOCUMENTS

| | | | |
|---|---|---|---|
| 2,755,827 | 7/1956 | Gerding | 144/23 |
| 2,780,253 | 2/1957 | Joa | 144/253 E |
| 3,163,190 | 12/1964 | Ervin | 144/23 X |
| 3,387,637 | 6/1968 | Ferguson et al. | 144/23 |

FOREIGN PATENT DOCUMENTS

| | | | |
|---|---|---|---|
| 55294 | 10/1938 | Denmark | 144/4 |

*Primary Examiner*—W. D. Bray

*Attorney, Agent, or Firm*—Larson & Taylor

[57] ABSTRACT

A dowell making machine which has a central hollow shaft which is adapted for rotation on connection to a driving means and has associated therewith an end plate which is co-axial with the shaft and adapted to rotate therewith, the end plate having a central aperture larger in diameter than the dowell to be made and having cutting blades thereabout, a cylindrical saw blade is associated with the tool and is co-axial with the axis of the aperture of the shaft and is located between the end plate and the shaft, the arrangement being such that timber passing through the end plate is force formed to a substantially cylindrical shape and, on passing through the cylindrical blade, is sized to form a dowell.

11 Claims, 5 Drawing Figures

DOWELL MAKING

This invention relates to dowell making and, in particular, to a dowell making machine which is satisfactory for use in a home workshop.

Conventionally, dowell has been made commercially by complex and expensive machinery which is certainly not adaptable for use in the home workshop.

The only proposal to permit a handyman, who very often has off-cuts of timber which are of a size satisfactory to make dowell, to make his own dowell, and it must be appreciated that a large quantity of dowell can be used by a workman, and dowell to purchase is relatively expensive, has been to provide an apertured plate having an aperture of the diameter of the size of dowell required and having clean sharp edges to effect a planing or chiselling of material driven therethrough. Such plates have only been acceptable, at best, for very short lengths of dowell.

It is the object of the present invention to provide a dowell making machine which is relatively inexpensive and, thus, is applicable for use in a home workshop or small industrial plant but which, at the same time, can, rapidly and accurately, form dowell of a required size.

The invention, in its broadest aspect, provides a dowell making machine having a central hollow shaft adapted for rotation on connection to driving means, an end plate located co-axial with the shaft and adapted to be located for rotation therewith, the end plate having a central aperture coaxial with the aperture of the shaft, the aperture being larger in diameter than the dowell to be made and having cutting blades thereabout a cylindrical saw blade associated with the tool and being co-axial with the axis of the aperture of the shaft, and between the end plate and the shaft, the arrangement being such that timber passing through the end plate is first formed to a substantially cylindrical shape and on passing through the cylindrical blade is sized to form a dowell. The central hollow rotatable shaft may be mounted in bearings and may be driven, for example, by a belt drive from a motor or it can be adapted to be located in the chuck of a lathe or the like.

Preferably there is a rest outwardly of the end plate which can support timber against rotation as it is fed through the machine.

In order that the invention may be more readily understood, I shall describe one particular form of dowell making machine made in accordance with the invention and as illustrated in the accompanying drawings; in which.

Figure 1:
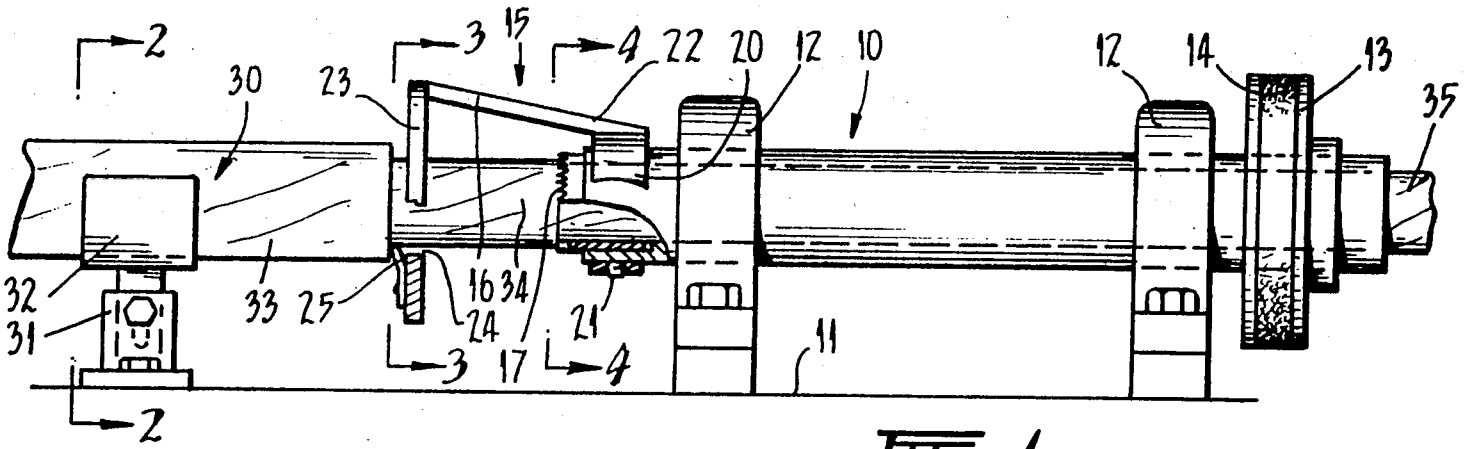
FIG. 1 is a side elevation, partly broken away, of the machine.
Figure 4:
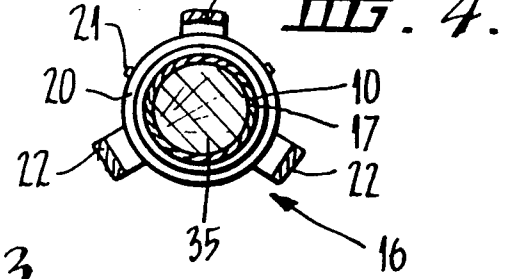
FIG. 4 is a section along line 4—4 of FIG. 1.
Figure 3:
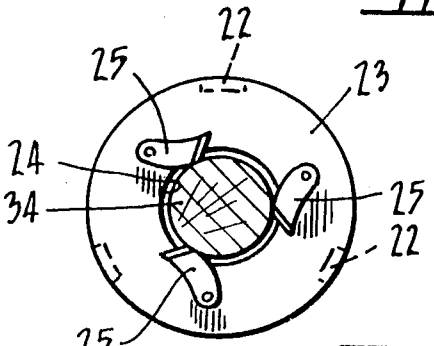
FIG. 3 is a section along line 3—3 of FIG. 1.
Figure 2:
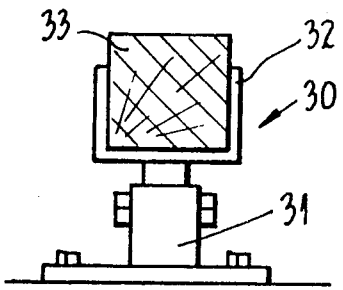
FIG. 2 is a section along line 2—2 of FIG. 1.

The machine to be described in relation to FIGS. 1 to 4, is specifically adapted for a particular size dowell, the most usual size being ⅜", but it will be appreciated that it will be possible to make a machine which can make different sizes of dowell simply by changing the components which effect the actual sizing.

Particular ways of doing this will not be described.

The machine basically consists of a hollow shaft 10 which is mounted for rotation about its longitudinal axis.

I may prefer to provide a base 11, which has extending upwardly thereform, two assemblies 12 which have bearings in which the shaft 10 can rotate, but any other arrangement, such as the provision of individual components for bench mounting would be equally satisfactory.

Whilst I may use a pair of spaced roller or tapered bearings each of which can accept a thrust load, I could, alternatively, use sintered metal or nylon bearings in association with one thrust washer or the like, which will accept end loads.

Various ways of mounting shafts for rotation are, of course, well known and will not be further described.

The shaft is provided with means whereby it can be rotated and I prefer to provide a pulley 13 adapted to receive a V-belt 14 or the like adjacent one end but, again, if required, the shaft could have a gear box or be driven in any other way.

The shaft, or a sleeve therein, has a diameter to closely receive the size of dowell to be made by the machine.

At the end of the shaft away from the pulley, I provide a head sub-assembly 15 which provides the means whereby the dowell can be formed.

This assembly consits of two parts, a spider 16 and a cylindrical saw blade 17.

The saw blade 17 has an internal diameter equal to the external diameter of the dowell to be made and may be formed integrally with the end of the shaft but, as illustrated, is preferably an insert into the shaft. The blade may be a press fit into the shaft or, alternatively, it may be held in position by grub screws or the like.

The spider 16, which may preferably be a casting, comprises, at what is its inner end, a collar 20 which is adapted to pass over the shaft and be located about portion of the shaft or over the saw blade, depending upon the particular formation of these, and has means, such as a grub screw or grub screws 21 whereby it can be connected to the shaft to rotate therewith.

Extending from this collar there are a plurality of outwardly directed arms 22 and, practically, I prefer to provide three such arms and, at the outer end of these, and they terminate outwardly beyond the cylindrical saw blade, there is an apertured end plate 23 which lies normal to the axis of the cylindrical shaft 10.

This plate has a central aperture 24 which is slightly larger than the required diameter of dowell to be formed. For example, if ⅜ dowell is to be manufactured, this aperture could be of the order of 7/16".

The arrangement is such that this aperture is co-axial both with the cylindrical saw blade 17 and the shaft 10.

Mounted on the end plate and about the aperture there are a series of cutting blades 25 which may be specially formed or which may well be cutting teeth from a chain saw chain. These blades are located symmetrically about the central aperture 24 of the plate and are arranged so that, on rotation of the plate, they will shape, to an effectively cylindrical surface, any timber passed therethrough.

The blades may be mounted to be adjustable or, if required, may simply be fixedly mounted and be replaced when worn through repeated sharpenings.

Located outwardly of the end plate there may be an adjustable rest 30 which can comprise a post 31 extending upwardly from the base and which is preferably mounted so as to be moveable transversely relative to the cutting assembly and which has located therein a rest member 32 which may be moveable vertically relative to the post. This rest is preferably in the form of a fork or the like having substantially square or rectangular sections.

In the operation of the device the rest member 32 is adjusted so that the fork is effectively central relative to the aperture 24 in the end plate 23, the cylindrical saw 17 and the shaft 10, depending upon the size of the material to be used therewith.

The timber stock 33 from which the dowell is made is preferably square or substantially square and this material is placed into the fork and is moved towards the apertured plate 23.

The shaft is driven from any required machine and, as the timber comes into contact with the cutting blades on the plate 23, so its external surface is contacted by the blades 25 and the semi-formed timber 34 is at least roughly shaped into an effectively cylindrical form of a diameter sufficiently small to pass through the end plate.

During this first part of the operation, the timber stock 33 is held against rotation because of the shape of the fork in the guide member, but, once the end of the timber passes through the end plate, it then becomes effectively supported and the blades on the end plate form the remainder of the timber accurately.

Further movement of the timber brings it into contact with the cylindrical saw 17 and this cuts the periphery of the timber until it is accurately sized to the internal diameter of the saw and the formed timber 35 then enters into the hollow shaft 10 and, as the operation continues, so the formed timber passes through the length of the hollow shaft.

It will be seen that, at this time, the timber is basically fully supported throughout the whole of the portion which is formed, it is also supported when slightly larger in diameter in the aperture in the end plate and is held against rotation by the fork in the support.

The forward movement continues and, when sufficient dowell has been formed, it passes through the outer end of the shaft and can then be grasped and the final portion of the dowell can be drawn forwardly through this, even after it has left the support until the whole of the dowell has been completed, at which time the completed dowell can be drawn fully from the shaft.

If required, at that stage, another dowell can be formed. It can be seen that the machine of the invention, whilst simple, forms a very accurately shaped dowell and this dowell is formed rapidly and cheaply from what would otherwise be waste stock.

Whilst in FIGS. 1 to 4 I have described an embodiment of machine which can be basically free standing, it will be appreciated that the invention can also be used with some other tool providing the rotation of the shaft 10.

Figure 5:
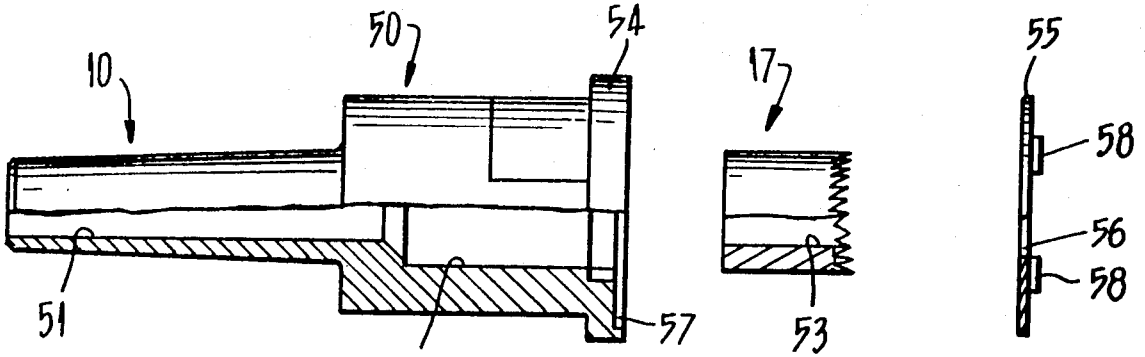
FIG. 5 is an exploded side elevation of a modified form of machine.

In a simple case, and as illustrated in FIG. 5, a tool can be made for use with a lathe having a hollow chuck head and, in this case, the shaft 10 which may be a Morse taper, can be clamped in the chuck.

In this case the shaft 10 may be made integral with the body 50.

The shaft 10 and body 50 have a bore 51, which is co-axial with the two components and which has a diameter slightly greater than the diameter of the largest sized dowell which is to be made with the device.

The forward end of the bore 51 opens into an enlarged bore 52 which may extend through the body 50 to the free end thereof.

This bore 52 is of a diameter such as to receive the blade 17.

The tool may be adapted to make several sizes of dowell, and for this to be effective there can be a number of different blades 17, each of which have a similar external diameter, but an internal bore 53 which is of the diameter of the dowell to be formed, and thus the teeth terminate at the level of the internal diameter.

At the outer end of the tool there is an enlarged diameter portion 54, which is adapted to receive a roughing cutter plate 55, which is effectively identical to the end plate 23 of the earlier embodiment. This roughing cutter 55 is adapted to be received in a counter bore 57 in the enlarged portion 54, and held there against rotation by grub screws or the like.

The roughing cutter has blades 58 located thereon and these may be blades similar to that described in relation to the earlier embodiment, or may be of a different form.

Again, it is preferred that different diameter roughing cutters be provided for the formation of different sized dowells, although this may not be absolutely critical where the variations in dowell sizes to be made are not great as the blade 17 may be able to cope with material of slightly different sizes.

Again, some form of support may be provided if required but, when the lathe is operated, and the chuck rotates, the timber stock can be passed through the aperture 56 in roughing cutter 55 in a manner similar to that previously described, the part formed timber passes to and through the cylindrical blades 17 and the completed dowell 35 passes through the length of the shaft 10.

In this case, the completed dowell is fed out through the rear of the lathe head stock. Apart from the form of rotation, the operation of this aspect of the invention is identical to that of the earlier embodiment, but it will be seen that the actual machine is very much simpler in that it does not need to have bearings or support means.

Similar arrangements can be used with other machines and these will not be described further as the mode of operation will be readily understood.

It may be possible to provide, adjacent but spaced from the end of the hollow shaft from which the dowell is removed, a tool or series of tools which can form a longitudinal groove along one side of the dowell, which grooves are conventional and are provided to permit the escape of air and glue when the dowell is being used, or an apertured plate having a cutting tooth extending therein may be provided and, through this plate, short lengths of dowell may be passed, the inwardly extending tooth being effective to form the groove in the dowell.

Whilst in this specification I have not dwelt at length on the manner in which the hollow shaft is supported and/or rotated, these are matters which are purely conventional and could readily be effected by any person skilled in the light engineering art.

Also, as mentioned earlier herein, I have not described fully ways in which to replace the cylindrical saw blade and the end plate to form dowell of different sizes, but it will be possible that this can be achieved readily, with the additional possible necessity of sleeving the hollow shaft so that the different sized dowells are fully supported as they pass through the machine.

I claim:

1. A dowell making machine having a central hollow rotatable shaft, a driving means and means for connecting the shaft to the driving means, an end plate located co-axial with the shaft and rotatable therewith, the end plate having a central aperture co-axial with the aperture of the shaft, the aperture being larger in diameter than the dowell to be made and having cutting blades thereabout, a cylindrical saw blade associated with the tool and being co-axial with the axis of the aperture of the shaft, and between the end plate and the shaft, the arrangement being such that timber passing through the end plate is first formed to a substantially cylindrical shape and on passing through the cylindrical blade is sized to form a dowell.

2. A machine as claimed in claim 1 including bearings, wherein the central hollow rotatable shaft is rotatably mounted in the bearings.

3. A machine as claimed in claim 1 wherein the central hollow rotatable shaft includes means for mounting the shaft in a driveable rotatable member.

4. A machine as claimed in claim 1 wherein the central hollow shaft includes a spider extending outwardly therefrom by which the end plate is co-axially located with the shaft.

5. A machine as claimed in claim 1 including adjustable cutting blades.

6. A machine as claimed in claim 1 wherein the cylindrical saw blade is affixed to the shaft.

7. A machine as claimed in claim 1 wherein the cylindrical saw blade is affixed into the shaft.

8. A machine as claimed in claim 1 having a rest outwardly of the end plate, which rest includes means for receiving the stock from which the dowell is to be made and to hold this stock against rotation.

9. A method of making a dowell using a dowell making machine having a central hollow rotatable shaft adapted for rotation by connection to a driving means, and having an end plate located co-axial with the shaft and adapted to be located for rotation therewith, the end plate having a central aperture co-axial with the aperture of the shaft, the aperture being larger in diameter than the dowell to be made and having cutting blades thereabout, and having a cylindrical saw blade associated with the tool and being co-axial with the axis of the aperture of the shaft, and between the end plate and the shaft, the arrangement is such that the timber passing through the end plate is first formed into a cylindrical shape and on passing through the cylindrical blade is sized to form a dowell, comprising the step of passing the stock from which the dowell is to be made through the machine.

10. A method according to claim 9, wherein the step of passing the stock through the machine includes passing the stock through a rotating cylindrical saw, the internal diameter of which is equivalent to the required dowell size.

11. The method of claim 9, wherein the step of passing the stock through the machine includes passing the stock through an apertured disk which has at least two blades about its periphery, to form the stock into a cylinder, the diameter of which is larger than the required diameter of the dowell.

* * * * *